US007896701B2

(12) United States Patent
Pei et al.

(10) Patent No.: US 7,896,701 B2
(45) Date of Patent: Mar. 1, 2011

(54) CONNECTOR AND LIGHT SOURCE APPARATUS

(75) Inventors: Chien-Chang Pei, Taipei (TW); Yi-Hung Chen, Taipei (TW); Feng-Ting Hsu, Taipei (TW)

(73) Assignee: Everlight Electronics Co., Ltd., Taipei (TW)

( * ) Notice: Subject to any disclaimer, the term of this patent is extended or adjusted under 35 U.S.C. 154(b) by 0 days.

(21) Appl. No.: 12/578,596

(22) Filed: Oct. 14, 2009

(65) Prior Publication Data

US 2010/0109501 A1 May 6, 2010

Related U.S. Application Data

(63) Continuation-in-part of application No. 12/368,974, filed on Feb. 10, 2009, now Pat. No. 7,621,782.

(30) Foreign Application Priority Data

Nov. 4, 2008 (TW) ..... 97142572 A
Oct. 2, 2009 (TW) ..... 98133564 A

(51) Int. Cl.
*H01R 33/00* (2006.01)

(52) U.S. Cl. ..... 439/619; 439/699.1

(58) Field of Classification Search ..... 439/619, 439/699.1, 668
See application file for complete search history.

(56) References Cited

U.S. PATENT DOCUMENTS

| | | | | |
|---|---|---|---|---|
| 4,631,377 | A | 12/1986 | Imazeki et al. | |
| 5,709,554 | A | 1/1998 | Savage, Jr. | |
| 6,409,530 | B1 | 6/2002 | Zhao et al. | |
| 7,101,230 | B2 * | 9/2006 | Ma | 439/668 |
| 7,322,828 | B1 | 1/2008 | Chiang | |
| 7,527,525 | B2 * | 5/2009 | Long et al. | 439/607.01 |
| 7,527,531 | B2 | 5/2009 | Lin | |
| 2006/0166562 | A1 | 7/2006 | Ma | |

OTHER PUBLICATIONS

"Search Report of European Counterpart Application" issued on Apr. 3, 2010, p. 1-p. 6.
"Notice of Allowance of US Prior Application" issued on Jul. 14, 2009, p. 1-p. 7.

* cited by examiner

*Primary Examiner* — Gary F. Paumen
(74) *Attorney, Agent, or Firm* — Jianq Chyun IP Office

(57) ABSTRACT

A connector adapted to be disposed on a carrier and electrically connected to the carrier is provided. The connector includes an insulating base and two electrodes. The insulating base has a first side surface, a second side surface, a bottom surface, and two through holes. The bottom surface connects the first and the second side surfaces. The through holes extend from the first side surface to the second side surface. The electrodes respectively penetrate the through holes. Each electrode has a bar portion and a bending portion extending from the bar portion. The bar portion is located in the corresponding through hole and protrudes away from the first side surface. The bending portion extends on the second side surface and toward the carrier. An end of the bending portion penetrates through the carrier and is electrically connected to the carrier. A light source apparatus is also provided.

33 Claims, 11 Drawing Sheets

CONNECTOR AND LIGHT SOURCE APPARATUS

CROSS-REFERENCE TO RELATED APPLICATION

This is a continuation-in-part application of and claims the priority benefit of patent application Ser. No. 12/368,974, filed on Feb. 10, 2009, which claims the priority benefit of Taiwan application serial no. 97142572, filed on Nov. 4, 2008. This application also claims the priority benefit of Taiwan application serial no. 98133564, filed on Oct. 2, 2009. The entirety of each of the above-mentioned patent applications is hereby incorporated by reference herein and made a part of this specification.

BACKGROUND OF THE INVENTION

1. Field of the Invention

The invention generally relates to a connector and a light source apparatus, and more particularly, to a connector for electrical connection and a light source apparatus using the same.

2. Description of Related Art

With the progress in semiconductor technology, the power attained by a light-emitting diode (LED) becomes increasingly larger, and the intensity of the light emitted is getting even higher. Further, due to its advantages in being power saving, environment-friendly, and durable with a rapid response and a small volume, the LED is widely applied in products such as illuminating apparatus, traffic signals, displays, and optical mice, and is on its way to replace the conventional fluorescent lamp.

In a conventional art, fixtures are adopted for fixing an LED tube onto the lamp holder of a conventional fluorescent lamp. However, as the fixtures are not conductive and may only be used to fix the tube, additional wires are required for electrically connecting the circuit board in the tube with the lamp holder. The additional wires have to be manually welded to the circuit board in the tube and the lamp holder, so that it is difficult to assemble/disassemble the LED tube, and the replacement of the tube is troublesome and time-consuming.

In order to solve the above problem of difficulty in assembling/disassembling the LED tube, the two electrode rods of the conventional fluorescent lamp adapted for insertion into the jack of the lamp holder are directly welded to the circuit board. However, the above manner may result in other problems such as the structural strength is insufficient and the two electrode rods are lacking in parallelism. In particular, similar to the assembly of the conventional fluorescent lamp, when the electrode rods of the LED tube are inserted in the jack of the lamp holder and the LED tube is turned to a fixed position, the torque force for turning the tube may easily damage the welding points between the electrode rods and the circuit board, and lead to a detachment of the electrode rods from the circuit board. Besides, it is rather difficult to maintain the parallelism of the two electrode rods in welding, and such design may cause a low yield.

SUMMARY OF THE INVENTION

Accordingly, an embodiment of the invention is directed to a connector with a high manufacturing yield.

An embodiment of the invention is also directed to a light source apparatus with higher reliability.

An embodiment of the invention provides a connector adapted to be disposed on a carrier and electrically connected to the carrier. The connector includes an insulating base and two electrodes. The insulating base has a first side surface, a second side surface, a bottom surface, and two through holes, wherein the second side surface is opposite to the first side surface. The bottom surface connects the first and the second side surfaces, and the through holes extend from the first side surface to the second side surface. The electrodes respectively penetrate the through holes. Each of the electrodes has a bar portion and a bending portion extending from the bar portion, wherein the bar portion is located in the corresponding through hole and protrudes away from the first side surface. The bending portion extends along the second side surface and toward the carrier. An end of the bending portion penetrates through the carrier and is electrically connected to the carrier.

In an embodiment of the invention, the bar portion and the bending portion of each of the electrodes are integrally formed.

In an embodiment of the invention, the bar portion of each of the electrodes has a first embedding portion, and the through hole corresponding to the bar portion has a second embedding portion inside the through hole. One of the first and the second embedding portions is embedded in the other of the first and the second embedding portions.

In an embodiment of the invention, the bar portions are substantially parallel to each other.

Another embodiment of the invention provides a connector adapted to be disposed on a carrier and electrically connected to the carrier. The connector includes an insulating base and two electrodes. The insulating base has a first side surface, a second side surface, a bottom surface, and two through holes, wherein the second side surface is opposite to the first side surface. The bottom surface connects the first and the second side surfaces, and the through holes extend from the first side surface to the second side surface. The electrodes respectively penetrate the through holes. Each of the electrodes has a bar portion and a bending portion extending from the bar portion, wherein the bar portion is located in the corresponding through hole and protrudes away from the first side surface. The bending portion extends from the second side surface to an underneath of the bottom surface, and the bending portion is located on the carrier and electrically connected to the carrier.

In an embodiment of the invention, the bar portion and the bending portion of each of the electrodes are integrally formed.

In an embodiment of the invention, the bar portion of each of the electrodes is a hollow bar portion or a solid bar portion.

In an embodiment of the invention, the bar portion of each of the electrodes has a first embedding portion, and the through hole corresponding to the bar portion has a second embedding portion inside the through hole. One of the first and the second embedding portions is embedded in the other of the first and second embedding portions.

In an embodiment of the invention, the first embedding portion is a recess, and the second embedding portion is a protrusion.

In an embodiment of the invention, the first embedding portion is a protrusion, and the second embedding portion is a recess.

In an embodiment of the invention, the bottom surface has two accommodating grooves, and the bending portions of the electrodes are respectively located in the accommodating grooves.

In an embodiment of the invention, the bending portion of each of the electrodes has a protrusion. The protrusion extends from the bottom surface and toward the carrier, and the protrusion penetrates through the carrier and is electrically connected to the carrier.

In an embodiment of the invention, the bar portion of each of the electrodes is an electrode rod, and the bending portion of each of the electrodes is an L-shaped electrode sheet.

In an embodiment of the invention, each of the electrode rods has a first end and a second end opposite to the first end. The first end protrudes from the first side surface. Each of the L-shaped electrode sheets has a bottom sub-portion and a connection sub-portion. The bottom sub-portion is disposed on the bottom surface, and the connection sub-portion is connected to the bottom sub-portion and disposed on the second side surface. The connection sub-portions of the L-shaped electrode sheets are connected to the second ends of the electrode rods, respectively.

In an embodiment of the invention, the second ends of the electrode rods are riveted to the connection sub-portions of the L-shaped electrode sheets, respectively.

In an embodiment of the invention, the second ends of the electrode rods penetrate the connection sub-portions so as to be riveted to the connection sub-portions, respectively.

In an embodiment of the invention, each of the L-shaped electrode sheets has a pin located below the bottom surface and protruding in a direction away from the bottom surface.

In an embodiment of the invention, the first side surface has two recesses respectively in communication with the two through holes. Each of the electrode rods has a flange located between the first end and the second end. The flanges of the electrode rods are respectively embedded in the recesses.

In an embodiment of the invention, the inner diameters of the recesses are larger than those of the through holes.

In an embodiment of the invention, the bar portions are substantially parallel to each other.

Another embodiment of the invention provides a light source apparatus, which includes a carrier, at least one light-emitting element, and a connector. The light-emitting element is disposed on the carrier. The connector is disposed on the carrier and electrically connected to the carrier. The connector includes an insulating base and two electrodes. The insulating base has a first side surface, a second side surface, a bottom surface, and two through holes, wherein the second side surface is opposite to the first side surface. The bottom surface connects the first and the second side surfaces, and the through holes extend from the first side surface to the second side surface. The electrodes respectively penetrate the through holes. Each of the electrodes has a bar portion and a bending portion extending from the bar portion. The bar portion is located in the corresponding through hole and protrudes away from the first side surface. The bending portion extends along the second side surface and toward the carrier. An end of the bending portion penetrates through the carrier and is electrically connected to the carrier.

In an embodiment of the invention, the carrier is a circuit board.

In an embodiment of the invention, the light-emitting element is a light-emitting diode (LED).

In an embodiment of the invention, the at least one light-emitting element is a plurality of light-emitting elements arranged along a straight reference line.

Another embodiment of the invention provides a light source apparatus, which includes a carrier, at least one light-emitting element, and a connector. The light-emitting element is disposed on the carrier. The connector is disposed on the carrier and electrically connected to the carrier. The connector includes an insulating base and two electrodes. The insulating base has a first side surface, a second side surface, a bottom surface, and two through holes, wherein the second side surface is opposite to the first side surface. The bottom surface connects the first and the second side surfaces, and the through holes extend from the first side surface to the second side surface. The electrodes respectively penetrate the through holes. Each of the electrodes has a bar portion and a bending portion connected to the bar portion. The bar portion is located in the corresponding through hole and protrudes away from the first side surface. The bending portion extends from the second side surface to an underneath of the bottom surface, and the bending portion is located on the carrier and electrically connected to the carrier.

Based on the above, in the connector of the embodiment consistent with the invention, the bar portions of the electrodes are inserted in the through holes of the insulating base, and the bending portion of the electrode can penetrate through the carrier or be joined to the carrier. Accordingly, by leaning the insulating base on the carrier, the insulating base is able to support the bar portions of the electrodes against external forces, and the bending portion of the electrode is stably joined to the carrier without being easily detached. Therefore, the light source apparatus is highly reliable. Moreover, as the bar portions of the electrodes of the connector according to the embodiment of the invention are inserted in the through holes of the insulating base, a high parallelism is easily maintained between the bar portions of the electrodes during assembly simply by making the two through holes parallel to each other in the manufacturing of the insulating base. Thus, the connector according to an embodiment of the invention achieves a high manufacturing yield, and the manufacturing yield and quality of the light source apparatus are further improved.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
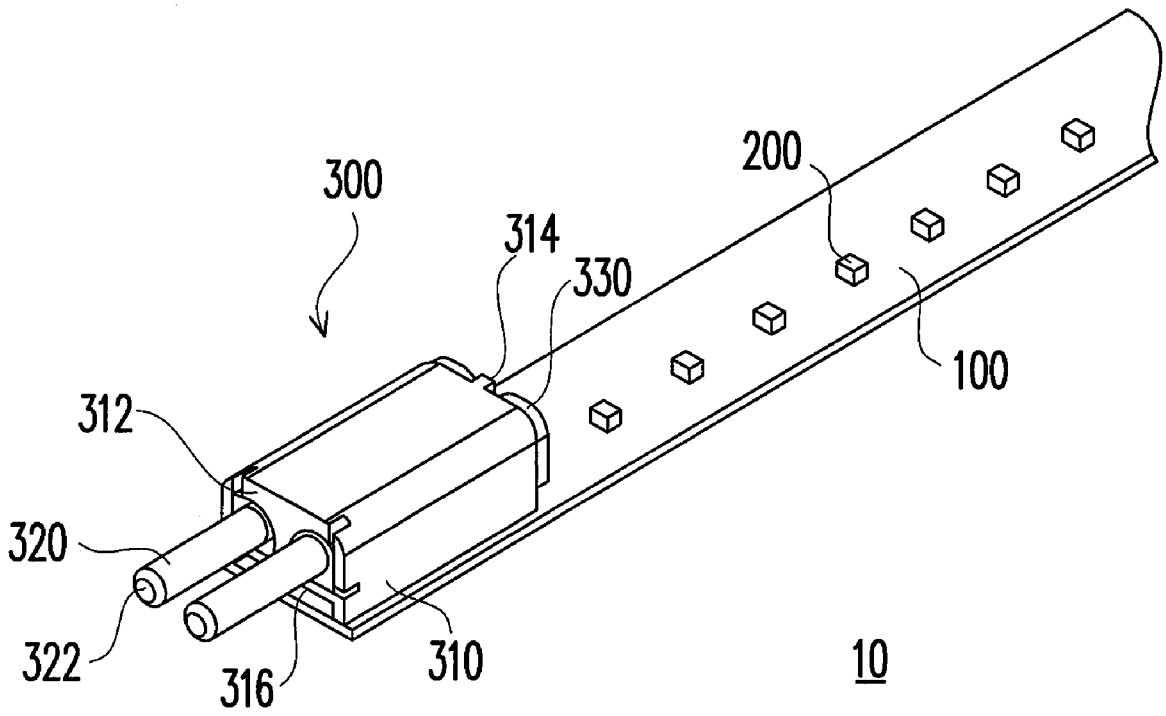
FIG. 1 is a schematic view of a light source apparatus according to an embodiment of the invention.

In the following detailed description of the preferred embodiments, reference is made to the accompanying drawings which form a part hereof, and in which are shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Similarly, the terms "facing," "faces" and variations thereof herein are used broadly and encompass direct and indirect facing, and "adjacent to" and variations thereof herein are used broadly and encompass directly and indirectly "adjacent to". Therefore, the description of "A" component facing "B" component herein may contain the situations that "A" component directly faces "B" component or one or more additional components are between "A" component and "B" component. Also, the description of "A" component "adjacent to" "B" component herein may contain the situations that "A" component is directly "adjacent to" "B" component or one or more additional components are between "A" component and "B" component. Accordingly, the drawings and descriptions will be regarded as illustrative in nature and not as restrictive.

In the embodiment of the invention, the light source apparatus includes a carrier, at least one light-emitting element, and a connector, wherein the connector includes an insulating base and two electrodes. The insulating base has two through holes, and the electrodes are inserted in the through holes and electrically connected to the carrier. The electrode herein may be an integrally formed element or a combined element formed by an electrode rod and an L-shaped electrode sheet. The electrodes are inserted in the through holes of the insulating base, and the electrode can penetrate through the carrier or be joined to the carrier. Accordingly, by leaning the insulating base on the carrier, the insulating base is able to support the electrode against external forces, and the electrode is stably joined to the carrier without being easily detached. Therefore, the light source apparatus of the embodiment consistent with the invention is highly reliable. A plurality of different embodiments is respectively used to describe the design of the light source apparatus and the connector hereinafter.

Figure 2:
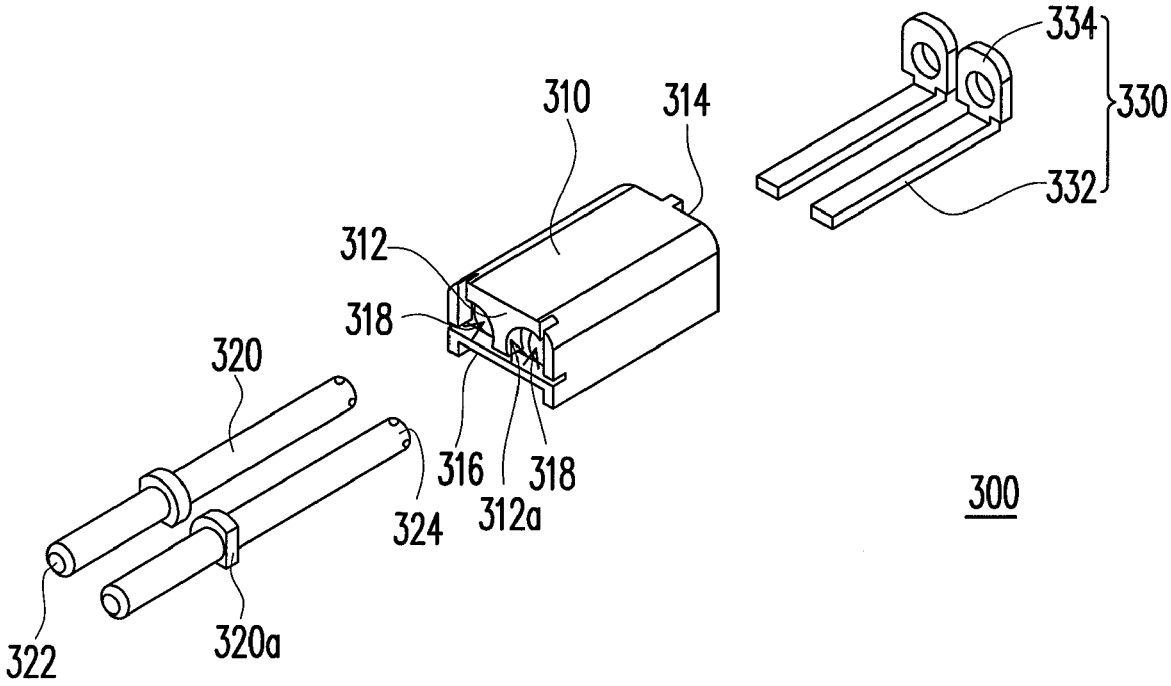
FIG. 2 is an exploded view of a connector in the light source apparatus in FIG. 1.

FIG. 1 is a schematic view of a light source apparatus according to an embodiment of the invention. FIG. 2 is an exploded view of a connector in the light source apparatus in FIG. 1. Referring to FIG. 1 and FIG. 2, the light source apparatus 10 includes a carrier 100, a plurality of light-emitting elements 200, and a connector 300, wherein the light-emitting elements 200 and the connector 300 are all disposed on the carrier 100, and the light-emitting elements 200 are electrically connected to the connector 300. In the present embodiment, the carrier 100 is, for example, a circuit board, and the light-emitting elements 200 are, for example, LEDs. Further, the light-emitting elements 200 are arranged along a straight reference line on the circuit board. The connector 300 includes an insulating base 310 and two electrodes, wherein each of the electrodes includes a bar portion 320 and a bending portion 330 connected to the bar portion 320. The insulating base 310 has a first side surface 312, a second side surface 314, a bottom surface 316, and two through holes 318. Herein, the second side surface 314 is disposed opposite to the first surface 312, and the bottom surface 316 connects the first side surface 312 and the second side surface 314.

Specifically, the two through holes 318 of the insulating base 310 penetrate the insulating base 310 and extend from the first side surface 312 to the second side surface 314. In the present embodiment, the bar portion of each of the electrodes 320 is an electrode rod, and the bending portion of each of the electrodes 330 is an L-shaped electrode sheet. The two electrode rods 320 respectively penetrate the two through holes 318, and a first end 322 of each electrode rod 320 protrudes from the first side surface 312 so as to be inserted in the jack of the lamp holder (not shown) for forming an electrical connection with the lamp holder. In the present embodiment, the specification of the lamp holder is, for example, G5. However, in other embodiments, the electrode rod 320 may also be designed in accordance with the specifications of other lamp holders. Moreover, in the present embodiment, the electrode rod 320 is in the shape of a cylinder. However, in other embodiments, the electrode rod may also be in the shape of a quadrangular prism or other shapes of rods.

Each of the L-shaped electrode 330 sheets has a bottom sub-portion 332 and a connection sub-portion 334. The bottom sub-portion 332 is disposed on the bottom surface 316 of the insulating base 310 and connected to the carrier 100. The connection sub-portion 334 is connected to the bottom sub-portion 332. In the present embodiment, the bottom sub-portion 332 is, for example, welded to the carrier 100, such that the connector 300 can be firmly fixed to the carrier 100. Here, the bottom sub-portion 332 may be welded to the carrier 100 through the surface mount technology (SMT). Each of the connection sub-portions 334 is disposed on the second side surface 314 and connected to the second ends 324 of the electrode rods 320, respectively. In other words, the L-shaped electrode sheets 330 are connected between the carrier 100 and the electrode rods 320. Therefore, the electrode rods 320 are electrically connected to the carrier 100 through the L-shaped electrode sheets 330.

In the present embodiment, the first side surface 312 of the connector 300 has two recesses **312*a* respectively in communication with the two through holes 318. More specifically, the inner diameters of the through holes 318 are suitable for receiving the electrode rods 320, and the inner diameters of the recesses 312*a* are larger than those of the through holes 318. Moreover, each of the electrode rods 320 may further have a flange 320***a* located between the first end 322 and the second end 324. When assembled, the flanges 320*a* of the electrode rods 320 are respectively embedded in the recesses 312*a* so as to fix the electrode rods 320 in the insulating base 310 of the connector 300.

Figure 3A:
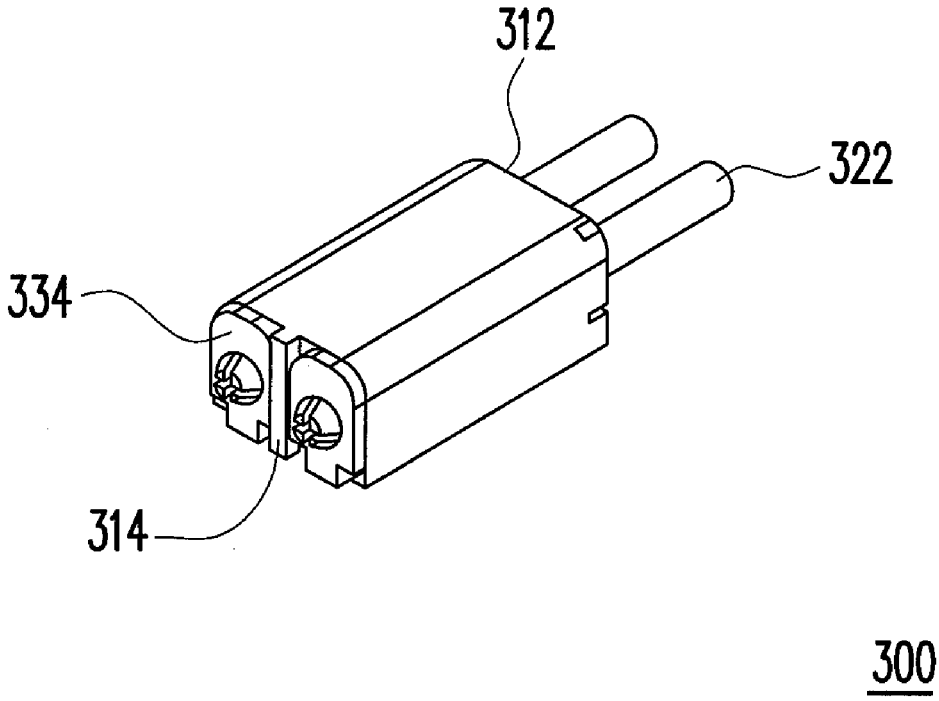
FIG. 3A is a schematic three-dimensional view of the connector in FIG. 1.
Figure 3B:
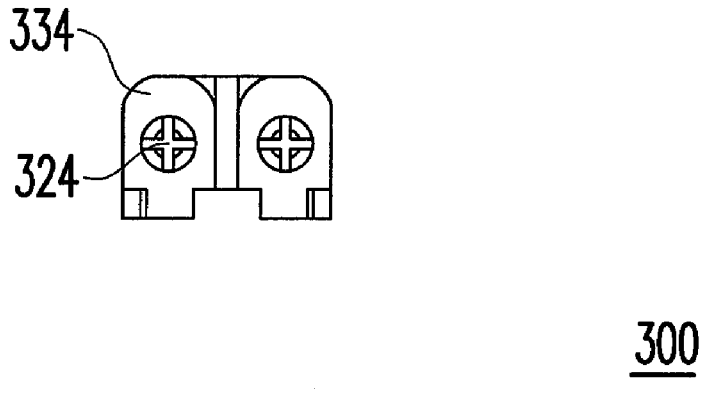
FIG. 3B is a schematic side view of the connector in FIG. 1.

FIG. 3A is a three-dimensional view of the connector in FIG. 1, and FIG. 3B is a side view of the connector in FIG. 1. Referring to FIG. 2, FIG. 3A, and FIG. 3B, in the present embodiment, the second ends 324 of the electrode rods 320 are riveted to the connection sub-portions 334 of the L-shaped electrode sheets 330. Specifically, the second ends 324 of the electrode rods 320 respectively penetrate the connection sub-portions 334 so as to be riveted to the connection sub-portions 334.

It should be noted that, in the following embodiments, the reference numbers and a part of context are the same as those in the foregoing embodiment, wherein the same reference numbers are used to represent the same or similar elements, and repetitive explanation is omitted. Regarding to the omitted explanation can be referred to the foregoing embodiment and is not repeated herein.

Figure 4:
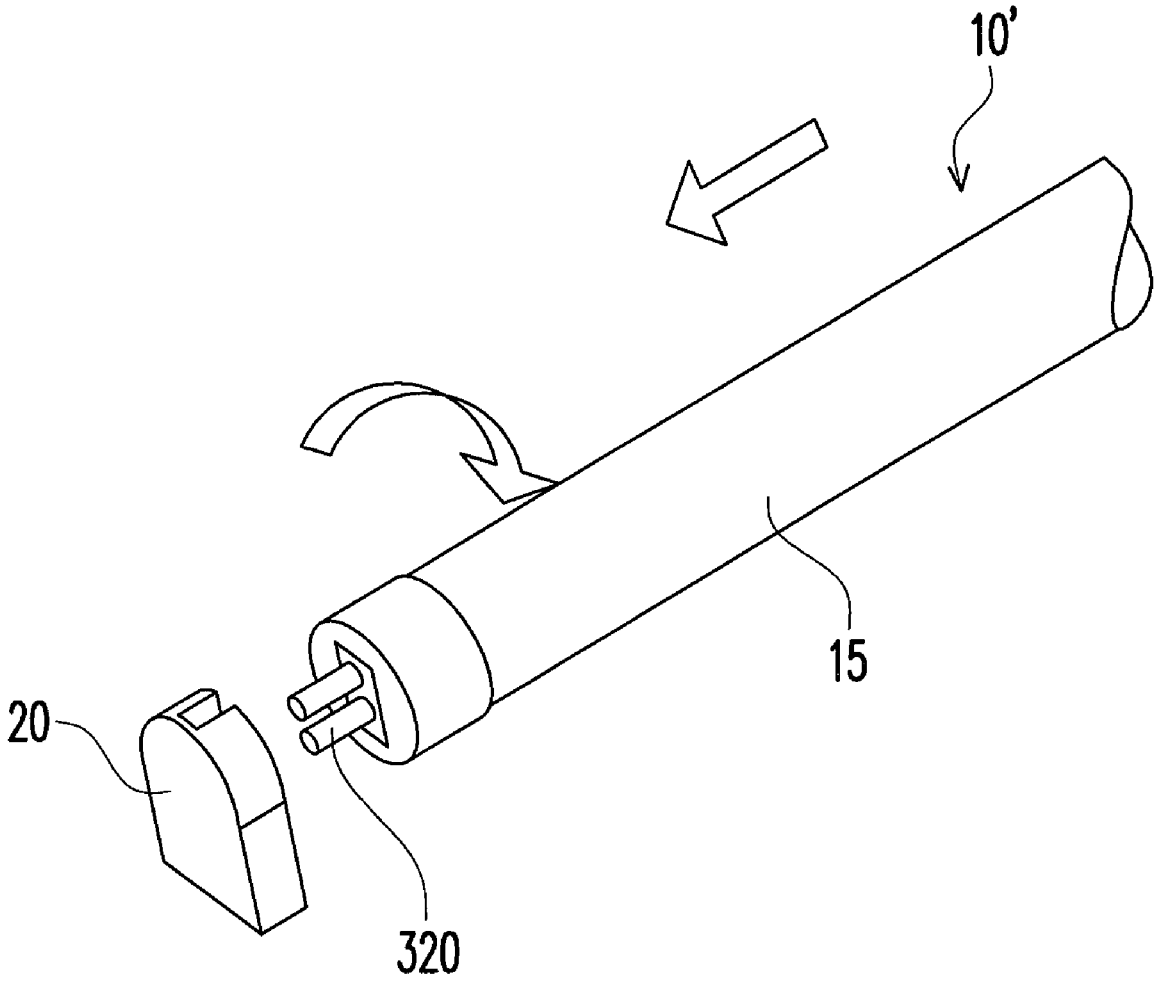
FIG. 4 is a schematic view of a light source apparatus assembled to a lamp holder according to another embodiment of the invention.

FIG. 4 is a schematic view of a light source apparatus assembled to a lamp holder according to another embodiment of the invention. Referring to FIG. 1, FIG. 2, and FIG. 4, compared with the above light source apparatus 10, the light source apparatus 10' of the present embodiment further includes a light transmissive lamp cover 15 enclosing the circuit 100 and the light-emitting elements 200. When the light source apparatus 10' is assembled to the lamp holder 20, the electrode rods 320 of the connector 300 must first be inserted in the lamp holder 20, and the light source apparatus 10' is then turned by an angle to a fixed position, such that the electrode rods 320 are communicated with an external power source. As the electrode rods 320 in the present embodiment are inserted in the through holes 318 of the insulating base 310 and the joint area between the bottom sub-portions 332 of the L-shaped electrode sheets 330 and the carrier 100 is large, when the light source apparatus 10' is turned, the insulating base 310 supports the electrode rods 320 against external forces, and the bottom sub-portions 332 are stably joined to the carrier 100 without being easily detached. Therefore, the light source apparatus 10 and the light source apparatus 10' are highly reliable.

Moreover, as two electrode rods 320 of the connector 300 in the present embodiment are inserted in the two through holes 318 of the insulating base 310, a high parallelism is easily maintained between the electrode rods 320 during assembly simply by making the two through holes parallel to each other in the manufacturing of the insulating base. Thus, the connector 300 of the present embodiment achieves a high manufacturing yield.

Figure 5:
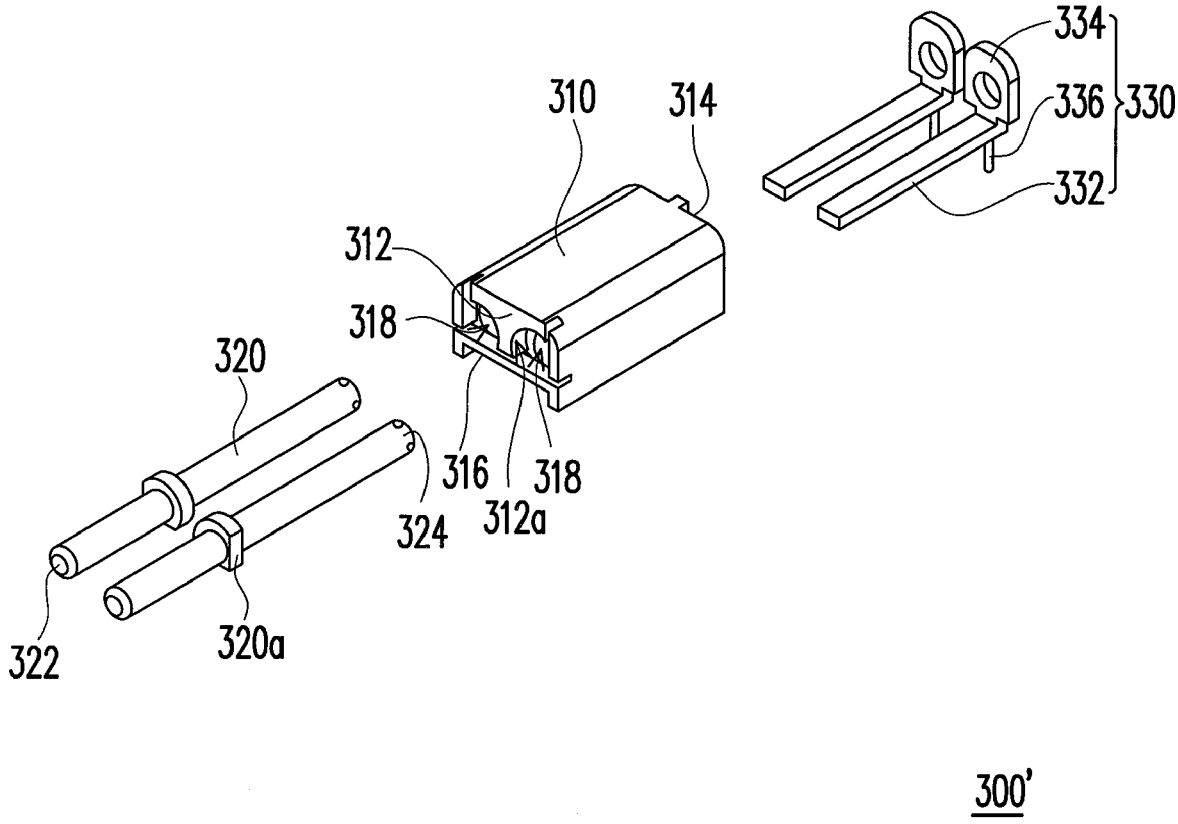
FIG. 5 is an exploded view of a connector according to another embodiment of the invention.

FIG. 5 is an exploded view of a connector according to another embodiment of the invention. Referring to FIG. 5, a connector 300' of the present embodiment is similar to the aforementioned connector 300 in FIG. 2 except for the following differences. In the connector 300', each of the L-shaped electrode sheets 330 further has a pin 336 located below the bottom surface 316 and protruding in a direction away from the bottom surface 316. The pin 336 is joined to the carrier by first penetrating the bored carrier 100 and then being welded to the carrier 100. In this manner, the L-shaped electrode sheets 330 are more stably joined to the carrier 100.

Figure 6A:
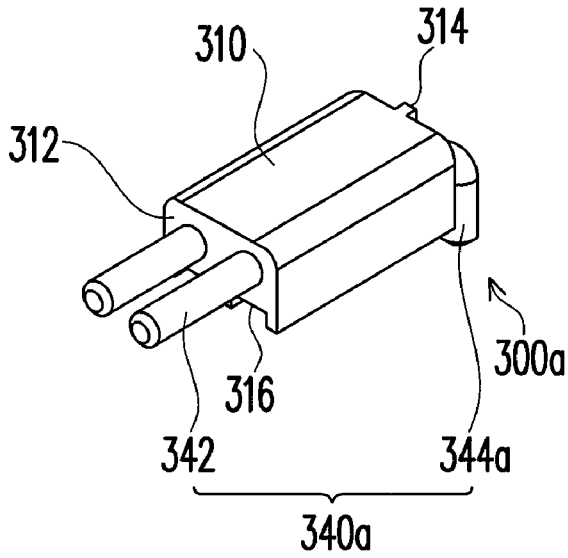
FIG. 6A is a schematic view of a connector according to another embodiment of the invention.
Figure 6B:
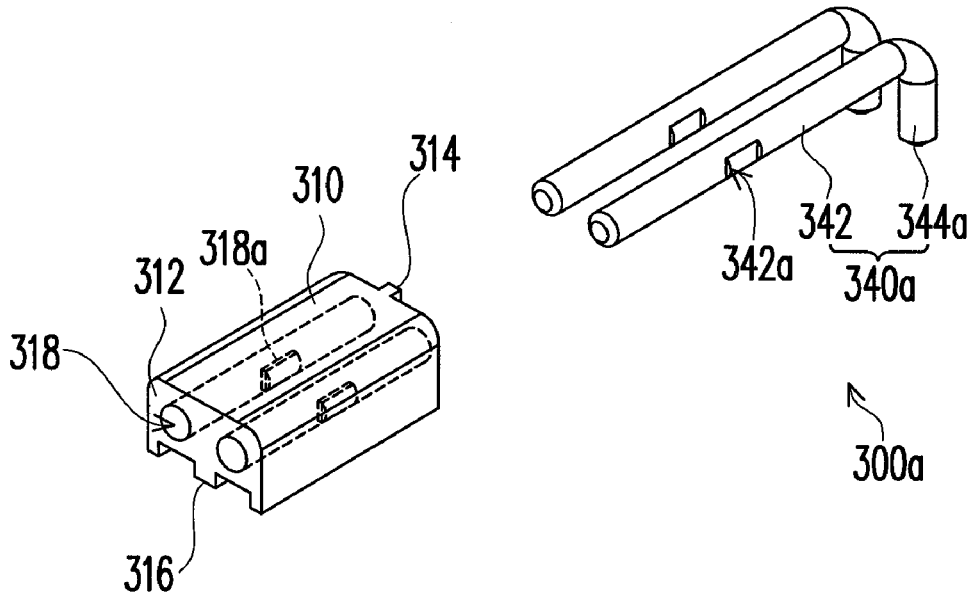
FIG. 6B is an exploded view of the connector shown in FIG. 6A.

FIG. 6A is a schematic view of a connector according to another embodiment of the invention. FIG. 6B is an exploded view of the connector shown in FIG. 6A. Referring to FIG. 6A and FIG. 6B, a connector 300*a* of the present embodiment is similar to the aforementioned connector 300 in FIG. 2 except for the following differences. In the connector 300*a*, each of the electrodes 340*a* have a bar portion 342 and a bending portion 344*a* extending from the bar portion 342, and the bar portion 342 and the bending portion 344*a* are integrally formed. That is, the electrodes 340*a* in the present embodiment are integrally formed elements. In the present embodiment, the electrodes 340*a* are substantially parallel to each other. Specifically, the bar portion 342 is located in the corresponding through hole 318 and protrudes away from the first side surface 312. The bending portion 344*a* extends along the second side surface 314 and toward the bottom surface 316. The bottom surface 316 faces the carrier 100, and an end of the bending portion 344*a* penetrates through the carrier 100 and is electrically connected to the carrier 100.

Furthermore, the bar portion 342 of each the electrodes 340*a* has a first embedding portion 342*a*, and the through hole 318 corresponding to the bar portion 342 has a second embedding portion 318*a* inside the through hole 318, wherein one of the first embedding portion 342*a* and the second embedding portion 318*a* is embedded in the other of the first embedding portion 342*a* and the second embedding portion 318*a*. In the present embodiment, the bar portions 342 are substantially parallel to each other. Moreover, in the present embodiment, the first embedding portion 342*a* is a recess, and the second embedding portion 318*a* is a protrusion. When the electrode 340*a* penetrates the through hole 318 of the insulating base 310, and one of the first embedding portion 342*a* and the second embedding portion 318*a* is embedded in the other of the first embedding portion 342*a* and the second embedding portion 318*a*, the electrode is stably fixed to the insulating base 310, and the insulating base 310 is able to support the bar portion 342 of the electrode 340*a* against external forces. Furthermore, as the electrode 340*a* is an integrally formed element, during the assembly of the connector 300*a*, the difficulty for assembly can be effectively reduced, so that the assembly yield of the connector 300*a* is enhanced. Furthermore, as the technology of pin through hole (PTH) is adopted in the present embodiment, the bending portion 344*a* of the electrode 340*a* penetrates through the carrier 100 and is electrically connected to the carrier 100. In this manner, the connector 300*a* can be more stably joined to the carrier 100 through the bending portion 344*a* of the electrode 340*a*, thereby enhancing the reliability of the light source apparatus 10.

It should be noted that, the invention is not limited to the configuration of the first embedding portion 342*a* and the second embedding portion 318*a*. Although the first embedding portion 342*a* mentioned herein is specified as a recess, and the second embedding portion 318*a* is specified as a protrusion, other known structure designs which can achieve the fixed effect are also technical solutions suitable for the invention and do not depart from the scope of the invention for which protection is sought. For example, in another embodiment (not shown), the first embedding portion 342*a* may be a protrusion, and the second embedding portion 318*a* may be a recess.

Figure 7A:
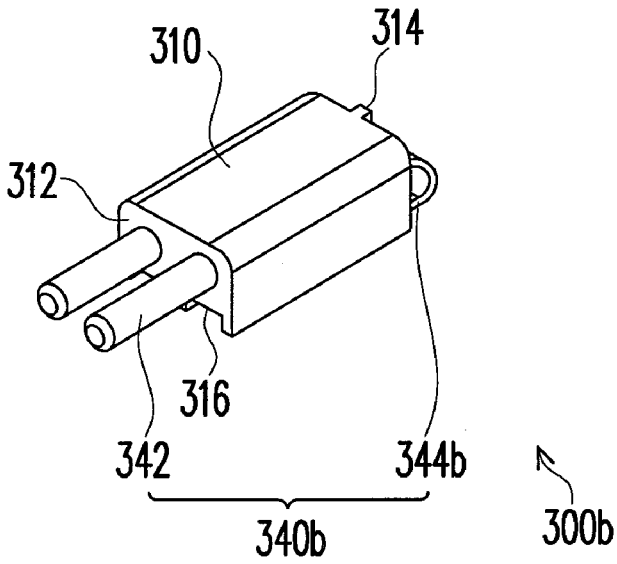
FIG. 7A is a schematic view of a connector according to another embodiment of the invention.
Figure 7B:
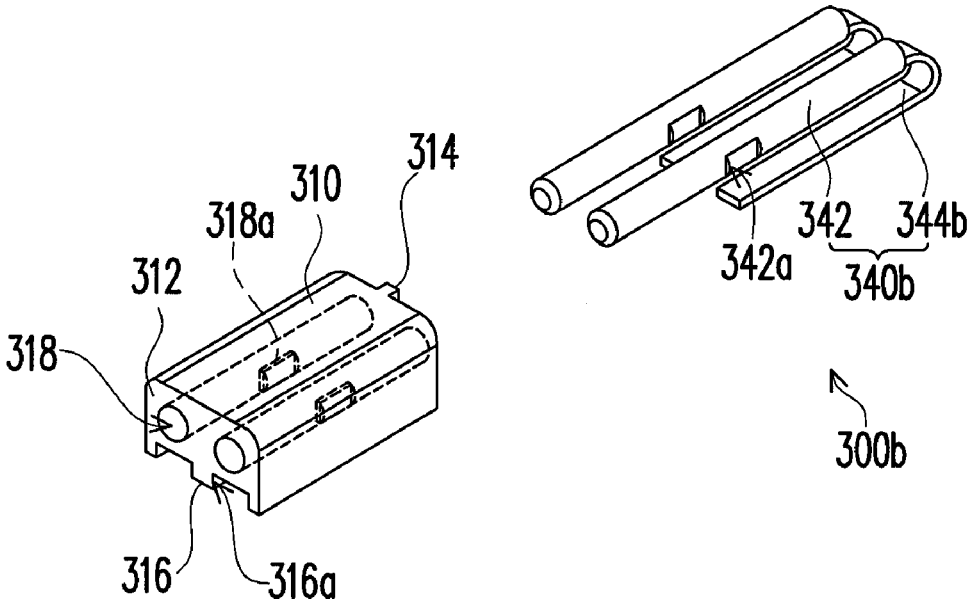
FIG. 7B is an exploded view of the connector shown in FIG. 7A.
Figure 7C:
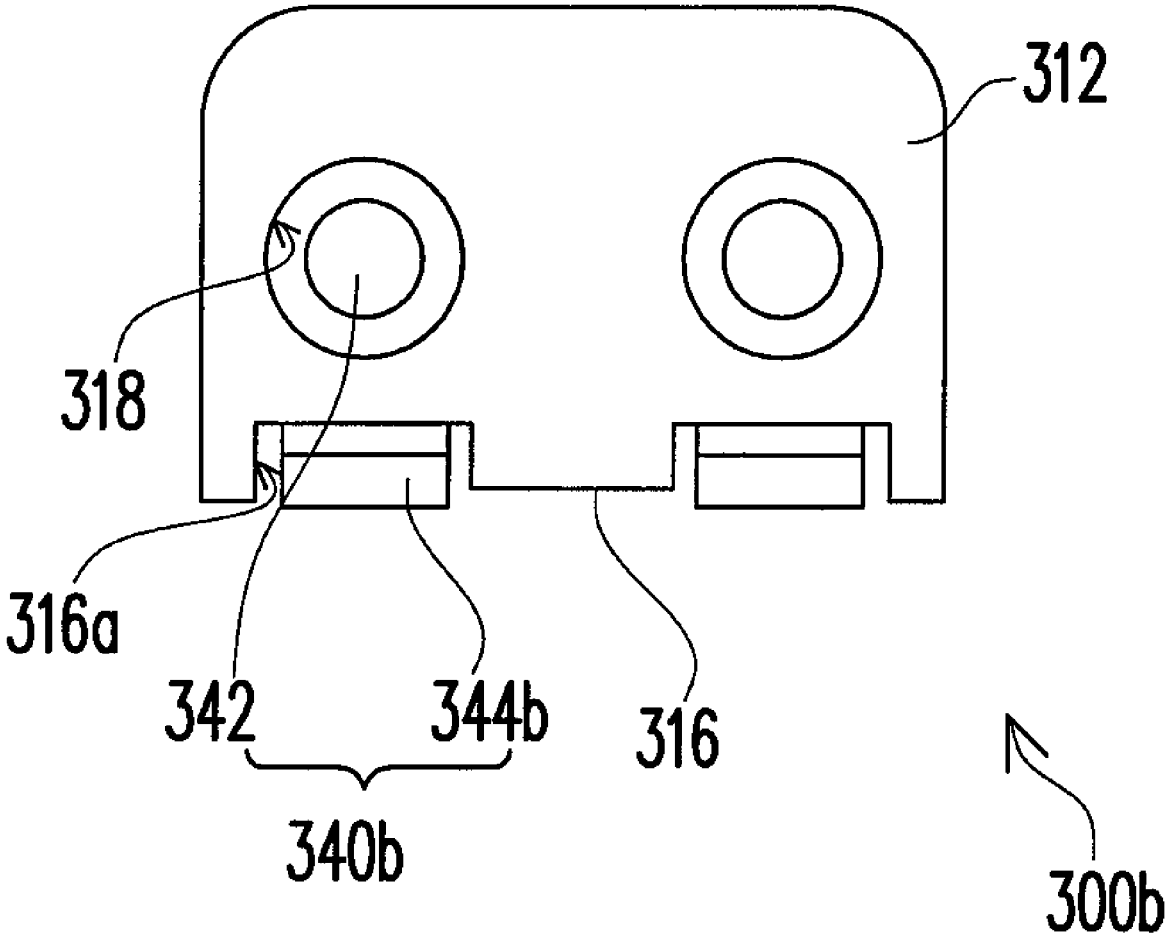
FIG. 7C is another side view of the connector shown in FIG. 7A.

FIG. 7A is a schematic view of a connector according to another embodiment of the invention. FIG. 7B is an exploded view of the connector shown in FIG. 7A. FIG. 7C is another side view of the connector shown in FIG. 7A. Referring to FIG. 7A, FIG. 7B and FIG. 7C, a connector 300*b* of the present embodiment is similar to the aforementioned connector 300*a* in FIG. 6A except for the following differences. In the connector 300*b*, each of the electrodes 340*b* includes a bar portion 342 and a bending portion 344*b* connected to the bar portion 342, wherein the bending portion 344*b* is extended from the bar portion 342, and the bar portion 342 and the bending portion 344*b* are integrally formed. That is, the electrodes 340*b* in the present embodiment are integrally formed elements. Furthermore, the bar portions 342 in the present embodiment are substantially parallel to each other. Specifically, the bar portion 342 is located in the corresponding through hole 318 and protrudes away from the first side surface 312. The bending portion 344*b* extends from the second side surface 314 to an underneath of the bottom surface 316, wherein the bottom surface 316 of the insulating base 310 has two accommodating grooves 316*a*, and the bending portion 344*b* of the electrodes 340*b* is located in the accommodating grooves 316*a*. The bending portion 344*b* is located on the carrier 100, welded to the carrier 100, and electrically connected to the carrier 100.

Figure 8A:
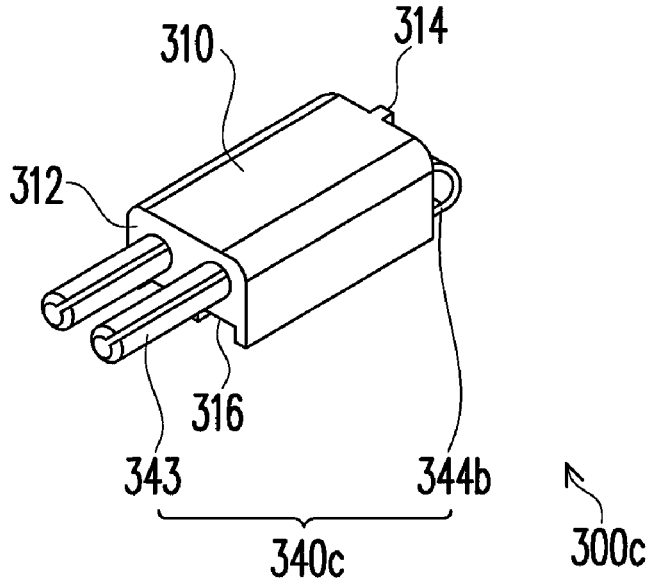
FIG. 8A is a schematic view of a connector according to another embodiment of the invention.
Figure 8B:
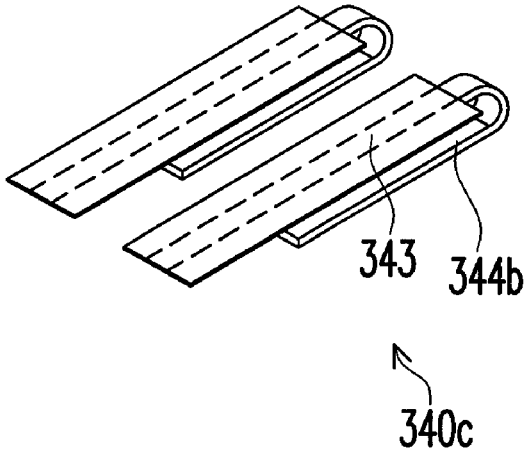
FIG. 8B illustrates a schematic view of the electrodes in FIG. 8A before the electrodes have been bent.

In the present embodiment, the bending portions 344*b* of the electrodes 340*b* are welded to the carrier 100 through the surface mounting technology (SMT), and the joint area of the bending portions 344*b* and the carrier 100 is relatively large. In this manner, the connector 300*b* is more stably joined to the carrier 100 without being easily detached through the bending portion 344*b* of the electrode 340*b*. Besides, in the present embodiment, the bar portion 342 of the electrode 340*b* may be a solid bar portion, and the bar portions 342 of the electrodes 340*b* are substantially parallel to each other. However, in other embodiments, referring to FIG. 8A, the bar portion 343 of the electrode 340*c* in the connector 300*c* may be a hollow bar portion. For the hollow bar portion, a plate 343 is first formed through the injection molding process, as shown in FIG. 8B. Next, the plate 343 is bended to form the hollow bar portion 343. In other words, the configuration of the bar portion 344 of the electrode 340*b* in FIG. 7A is simply exemplary for illustration and does not limit the invention.

Figure 9A:
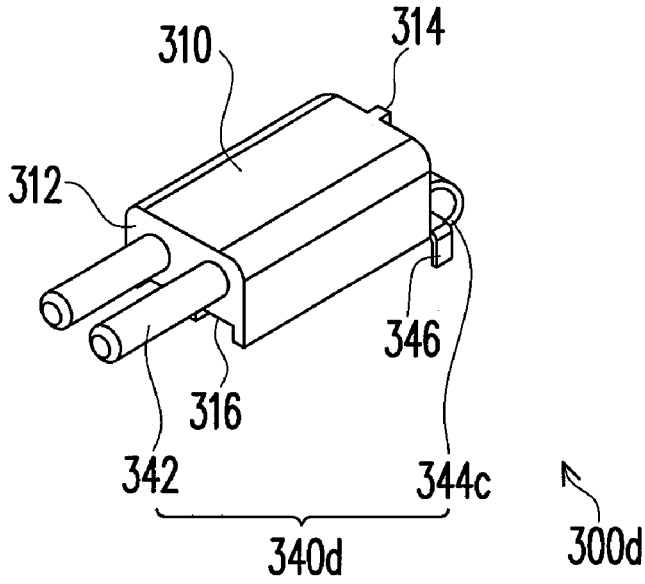
FIG. 9A is a schematic view of a connector according to another embodiment of the invention.
Figure 9B:
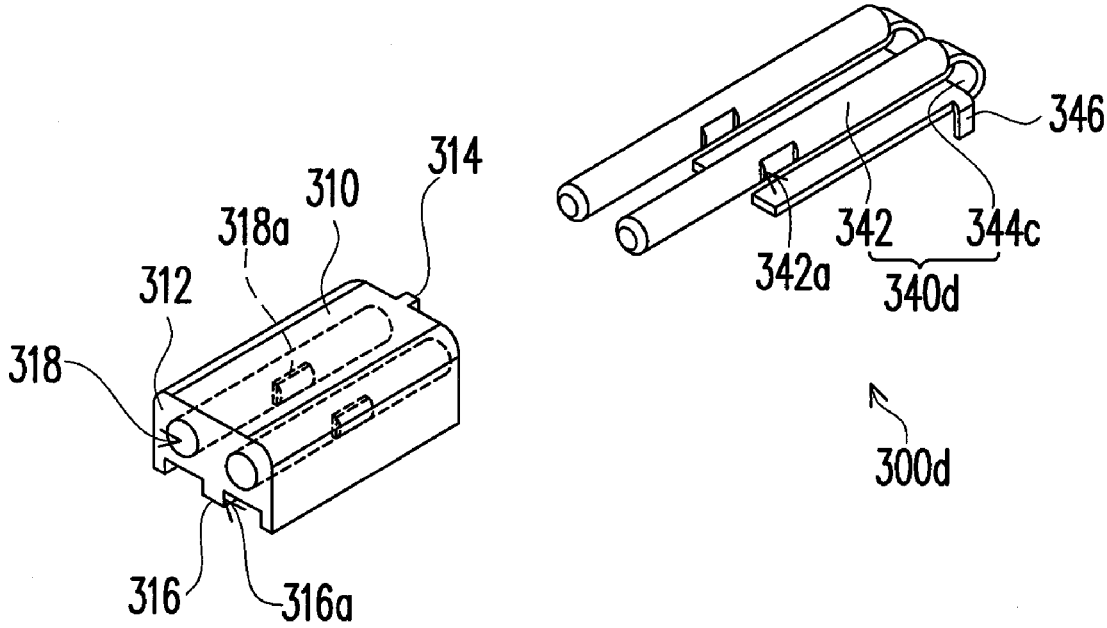
FIG. 9B is an exploded view of the connector shown in FIG. 9A.
Figure 9C:
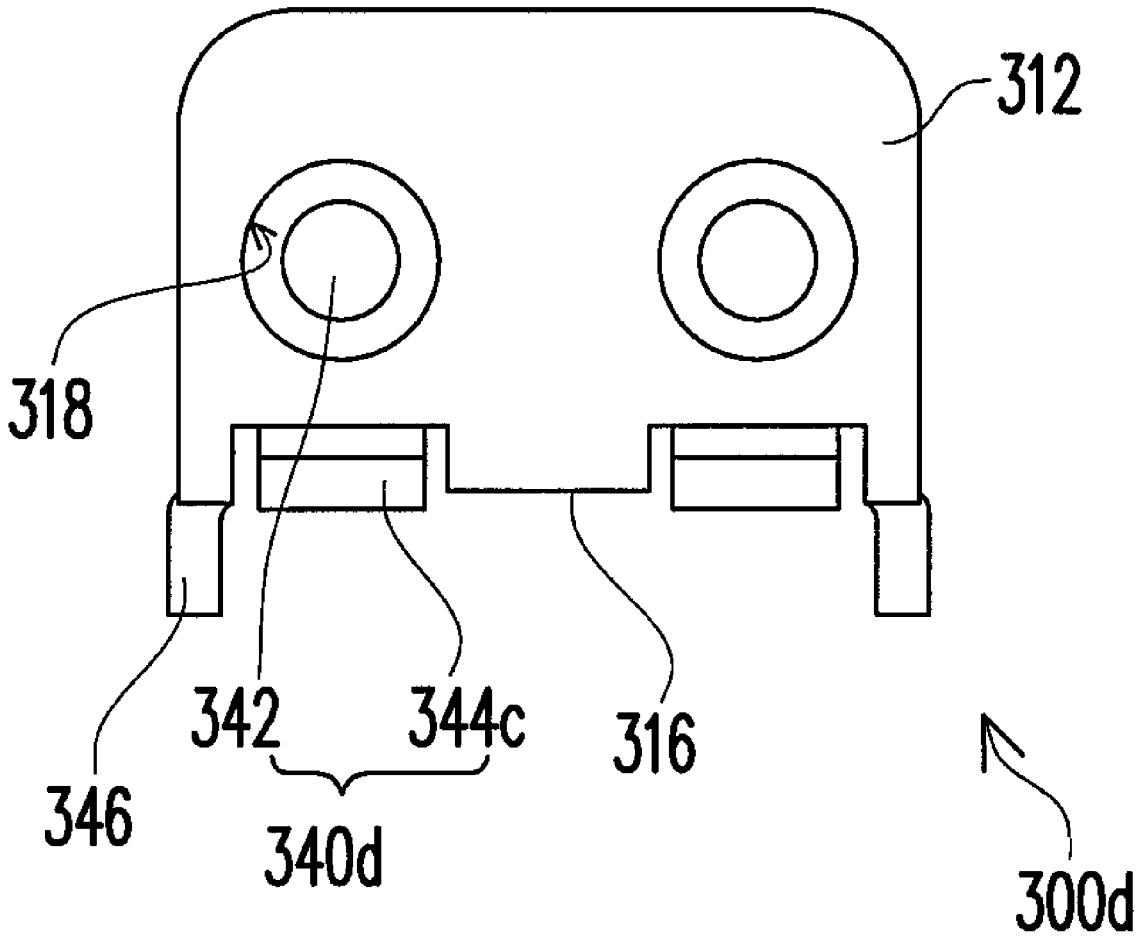
FIG. 9C is another side view of the connector shown in FIG. 9A.

FIG. 9A is a schematic view of a connector according to another embodiment of the invention. FIG. 9B is an exploded view of the connector shown in FIG. 9A. FIG. 9C is another side view of the connector shown in FIG. 9A. Referring to FIG. 9A, FIG. 9B and FIG. 9C, a connector 300*d* of the present embodiment is similar to the aforementioned connector 300*b* in FIG. 7A except for the following differences. In the connector 300*d*, the bending portion 344*c* of each electrode 340*d* has a protrusion 346. The protrusion 346 extends from the bottom surface 316 and toward the carrier 100, and the protrusion 346 penetrates through the carrier 100 and is electrically connected to the carrier 100.

In the present embodiment, the connector 300*d* is fixed on the carrier 100 through the technologies of PTH and SMT simultaneously. Specifically, by SMT, the bending portion 344*c* of electrode 340*d* is welded to the carrier 100, and by PTH, the protrusion 346 of the bending portion 344*c* penetrates through the carrier 100 so as to be electrically connected to the carrier 100. In this manner, the connector 300*d* can be more stably joined to the carrier 100 without being easily detached. To sum up, in the connector of the embodiment consistent with the invention, the electrode rods are inserted in the through holes of the insulating base, and the joint area between the bottom sub-portions of the L-shaped electrode sheets and the carrier is large. Accordingly, the insulating base is able to support the electrode rods against external forces, and the bottom sub-portions of the L-shaped electrode sheets are stably joined to the carrier without being easily detached. Therefore, the light source apparatus is highly reliable.

Moreover, in the embodiment consistent with the invention, as the two electrode rods are inserted in the two through holes of the insulating base, a high parallelism is easily maintained between the two electrode rods during assembly simply by making the two through holes parallel to each other in the manufacturing of the insulating base. Thus, the connector of the embodiment consistent with the invention achieves a high manufacturing yield, and the manufacturing yield and quality of the light source apparatus are further improved.

Furthermore, in the embodiment consistent with the invention, the connector is fixed on the carrier 100 through the technologies of PTH and/or SMT. As a result, it is ensured that the connector is stably joined to the carrier without being easily detached. The yield can be effectively enhanced during the assembly of the connector and the carrier, thereby enhancing the reliability the light source apparatus. Moreover, the electrodes of the connector in the embodiment consistent with the invention can be integrally formed. Accordingly, during the assembly of the connector, the difficulty can be effectively reduced, thereby enhancing the assembly yield of the connector.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A connector, adapted to be disposed on a carrier and electrically connected to the carrier, the connector comprising:

an insulating base having a first side surface, a second side surface, a bottom surface, and two through holes, wherein the second side surface is opposite to the first side surface, the bottom surface connects the first and the second side surfaces, and the through holes extend from the first side surface to the second side surface; and two electrodes respectively penetrating the through holes, and each of the electrodes comprising a bar portion and a bending portion connecting to the bar portion, wherein the bar portion is located in the corresponding through hole and protrudes away from the first side surface, the bending portion extends from the second side surface to an underneath of the bottom surface, and the bending portion is located on the carrier and electrically connected to the carrier.

2. The connector as claimed in claim 1, wherein the bar portion and the bending portion of each of the electrodes are integrally formed.

3. The connector as claimed in claim 1, wherein the bar portion of each of the electrodes is a hollow bar portion or a solid bar portion.

4. The connector as claimed in claim 1, wherein the bar portion of each of the electrodes has a first embedding portion, the through hole corresponding to the bar portion has a second embedding portion inside the through hole, and one of the first and the second lock portions is embedded in the other of the first and the second lock portions.

5. The connector as claimed in claim 1, wherein the bottom surface has two accommodating grooves, and the bending portions of the electrodes are respectively located in the accommodating grooves.

6. The connector as claimed in claim 1, wherein the bending portion of each of the electrodes has a protrusion, the protrusion extends from the bottom surface and toward the carrier, and the protrusion penetrates through the carrier and is electrically connected to the carrier.

7. The connector as claimed in claim 1, wherein the bar portion of each of the electrodes is an electrode rod, and the bending portion of each of the electrodes is an L-shaped electrode sheet.

8. The connector as claimed in claim 7, wherein each of the electrode rods has a first end and a second end opposite to the first end, the first end protrudes from the first side surface, each of the L-shaped electrode sheets comprises a bottom sub-portion and a connection sub-portion, the bottom sub-portion is disposed on the bottom surface, the connection sub-portion is connected to the bottom sub-portion and disposed on the second side surface, and the connection sub-portions of the L-shaped electrode sheets are connected to the second ends of the electrode rods, respectively.

9. The connector as claimed in claim 8, wherein the second ends of the electrode rods are riveted to the connection sub-portions of the L-shaped electrode sheets, respectively.

10. The connector as claimed in claim 9, wherein the second ends of the electrode rods penetrate the connection sub-portions so as to be riveted to the connection sub-portions, respectively.

11. The connector as claimed in claim 8, wherein each of the L-shaped electrode sheets comprises a pin located below the bottom surface and protruding in a direction away from the bottom surface.

12. The connector as claimed in claim 8, wherein the first side surface has two recesses respectively in communication with the two through holes, each of the electrode rods has a flange located between the first end and the second end, and the flanges of the electrode rods are respectively embedded in the recesses.

13. The connector as claimed in claim 8, wherein inner diameters of the recesses are larger than those of the through holes.

14. The connector as claimed in claim 1, wherein the bar portions are substantially parallel to each other.

15. A light source apparatus, comprising:

a carrier;

at least one light-emitting element, disposed on the carrier; and a connector, disposed on a carrier and electrically connected to the carrier, the connector comprising:

an insulating base having a first side surface, a second side surface, a bottom surface, and two through holes, wherein the second side surface is opposite to the first side surface, the bottom surface connects the first and the second side surfaces, and the through holes extend from the first side surface to the second side surface; and two electrodes respectively penetrating the through holes, and each of the electrodes comprising a bar portion and a bending portion connecting to the bar portion, wherein the bar portion is located in the corresponding through hole and protrudes away from the first side surface, the bending portion extends from the second side surface to an underneath of the bottom surface, and the bending portion is located on the carrier and electrically connected to the carrier.

16. The light source apparatus as claimed in claim 15, wherein the bar portion and the bending portion of each of the electrodes are integrally formed.

17. The light source apparatus as claimed in claim 15, wherein the bar portion of each of the electrodes is a hollow bar portion and a solid bar portion.

18. The light source apparatus as claimed in claim 15, wherein the bending portion of each of the electrodes is welded to the carrier.

19. The light source apparatus as claimed in claim 15, wherein the bar portion of each of the electrodes has a first embedding portion, the through hole corresponding to the bar portion has a second embedded portion inside the through hole, and one of the first and the second embedding portions is embedded in the other of the first and the second embedding portions.

20. The light source apparatus as claimed in claim 15, wherein the bottom surface has two accommodating grooves, and the bending portions of the electrodes are respectively located in the accommodating grooves.

21. The light source apparatus as claimed in claim 15, wherein the bending portion of each of the electrodes has a protrusion, the protrusion extends from the bottom surface and toward the carrier, and the protrusion penetrates through the carrier and is electrically connected to the carrier.

22. The light source apparatus as claimed in claim 15, wherein the bar portion of each of the electrodes is an electrode rod, and the bending portion of each of the electrodes is an L-shaped electrode sheet.

23. The light source apparatus as claimed in claim 22, wherein each of the electrode rods has a first end and a second end opposite to the first end, the first end protrudes from the first side surface, each of the L-shaped electrode sheets has a bottom sub-portion and a connection sub-portion, the bottom sub-portion is disposed on the bottom surface, the connection sub-portion is connected to the bottom sub-portion and disposed on the second side surface, and the connection sub-portions of the L-shaped electrode sheets are connected to the second ends of the electrode rods, respectively.

24. The light source apparatus as claimed in claim 23, wherein the second ends of the electrode rods are riveted to the connection sub-portions of the L-shaped electrode sheets, respectively.

25. The connector as claimed in claim 24, wherein the second ends of the electrode rods penetrate the connection sub-portions so as to be riveted to the connection sub-portions, respectively.

26. The light source apparatus as claimed in claim 23, wherein the connection sub-portions are welded to the carrier.

27. The light source apparatus as claimed in claim 23, wherein each of the L-shaped electrode sheets comprises a pin located below the bottom surface and protruding in a direction away from the bottom surface.

28. The light source apparatus as claimed in claim 23, wherein the first side surface comprises two recesses respectively in communication with the two through holes, each of the electrode rods comprises a flange located between the first end and the second end, and the flanges of the electrode rods are respectively embedded in the recesses.

29. The light source apparatus as claimed in claim 28, wherein inner diameters of the recesses are larger than those of the through holes.

30. The light source apparatus as claimed in claim 15, wherein the carrier is a circuit board.

31. The light source apparatus as claimed in claim 15, wherein the light-emitting element is a light-emitting diode (LED).

32. The light source apparatus as claimed in claim 15, wherein the at least one light-emitting element is a plurality of light-emitting elements arranged along a straight reference line.

33. The light source apparatus as claimed in claim 15, wherein the bar portions are substantially parallel to each other.

* * * * *